United States Patent [19]

Yale

[11] 4,089,419

[45] May 16, 1978

[54] REVERSIBLE ENVELOPE

[76] Inventor: Robert S. Yale, 1660-A Avon Pl., NW., Washington, D.C. 20007

[21] Appl. No.: 837,866

[22] Filed: Sep. 29, 1977

[51] Int. Cl.[2] ..... B65D 27/32; B65D 27/06

[52] U.S. Cl. ..... 206/632; 229/73

[58] Field of Search ..... 229/71, 73; 206/632, 206/633

[56] References Cited

U.S. PATENT DOCUMENTS

| | | | |
|---|---|---|---|
| 877,330 | 1/1908 | Harvey | 229/73 |
| 1,145,935 | 7/1915 | Steinke | 229/73 |
| 2,588,950 | 3/1952 | Woolsey | 229/73 |
| 3,558,040 | 1/1971 | Krueger | 229/73 |
| 3,853,262 | 12/1974 | Tucker et al. | 206/632 |

FOREIGN PATENT DOCUMENTS

| | | | |
|---|---|---|---|
| 316,972 | 11/1969 | Sweden | 206/633 |

*Primary Examiner*—Stephen P. Garbe

*Attorney, Agent, or Firm*—Bacon & Thomas

[57] ABSTRACT

A blank for a returnable envelope has a main panel with a window and end and side flaps. One of the side flaps has a return address on one face of the blank and releasable adhesive on the other face along the outer edge. The other side flap has a moisture activatable adhesive along its outer edge and end edges on the same face of the blank as the return address. The blank can be folded to form an envelope, stuffed with an enclosure and releasably sealed, all by automatic machinery, then opened without tearing or severing any part and reversely folded and sealed for return mailing with the return address visible through the window.

8 Claims, 2 Drawing Figures

REVERSIBLE ENVELOPE

BACKGROUND OF THE INVENTION

This invention is in the field of stationery and particularly remailable envelopes.

The concept of providing an envelope that can be closed and mailed and one whereby the receiver may then open the envelope to obtain its contents and use the same envelope for a return mailing is old and many attempts have been made to provide a satisfactory envelope capable of such use. It is desirable to be able to use the same envelope for return mailing to conserve paper, which becomes an expensive item where a great number of mailing are made from, for example, business establishments in billing their customers. It is further desirable that the first mailings be capable of being handled, that is, formed into an envelope stuffed with an enclosure and closed for mailing all by automatic machinery. It is further desirable that such mailings be capable of being reused for return to the sender.

An example of a returnable envelope is shown in the patent to Harvey No. 877,330 where the main panel of his envelope is provided with interlocking end flaps and a top and bottom flap. For the first mailing the bottom flap is folded up over the end flaps, then the top flap is folded downwardly and adhered to the bottom flap by adhesive provided on one face of the envelope material. The bottom flap is provided with adhesive material on the other face of the sheet so that it underlies the top flap when the latter is sealed for the first mailing. The recipient opens the letter by severing the top flap along the edge of the adhesive material and the envelope can then be used for remailing by reversible folding of all flaps against the other face of the sheet material and the bottom flap then is folded last and its adhesive material used to seal the envelope. In both the first and second mailings, however, the adhesive is permanent and the flap must be actually severed to provide access to the contents thus leaving its severed edge inside the remailed envelope.

SUMMARY OF THE INVENTION

The present invention relates to a blank for an envelope capable of being handled entirely by automatic machinery and yet which can be reused for return mailing without ever severing or separating any portions of the blank. In general, the invention relates to a business envelope having a window therein and the sender's return address printed on a flap which address appears on the outside of the envelope for the first mailing but when the blank is reversed for return mailing, the address appears in the window as the address to which it is then to be sent. For the first mailing the envelope is closed by releasable adhesive means which may be a row of small spots of adhesive or a pressure sensitive adhesive that may be readily released without tearing the material of the envelope.

DESCRIPTION OF THE PREFERRED EMBODIMENT

Figure 1:
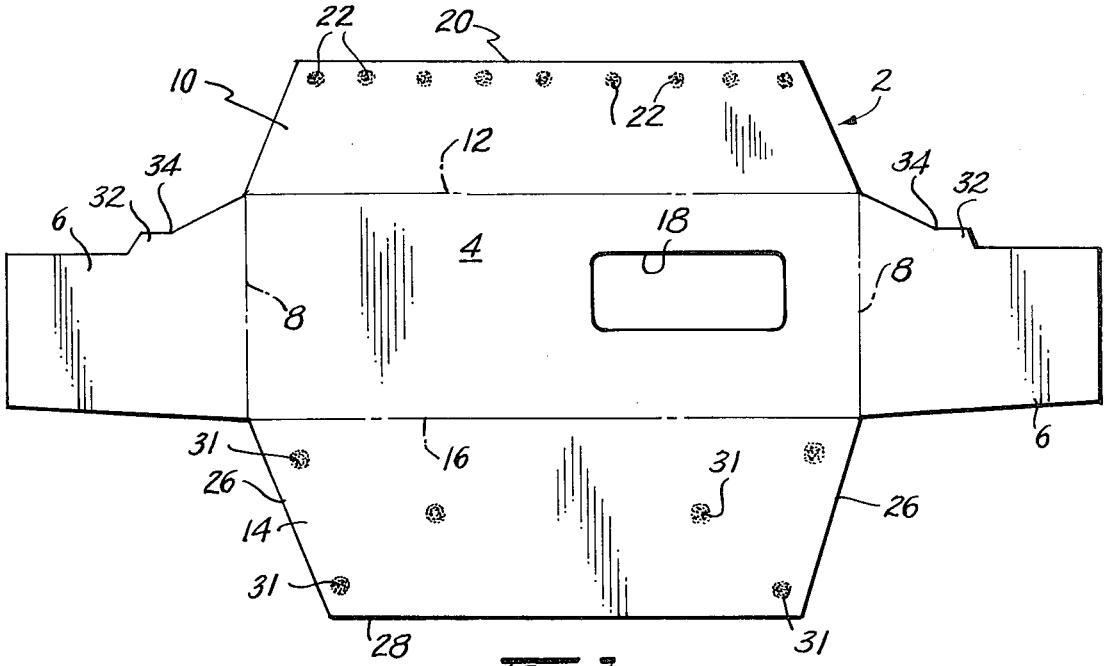
FIG. 1 is a view of a blank for forming an envelope showing one face thereof.

In the drawings, numeral 2 designates generally a blank of sheet material, such as paper, defining a rectangular main panel 4 having end flaps 6 extending from its ends and being integrally joined thereto along fold lines 8. The lines 8 may be score lines to facilitate folding but such score lines are not essential. An integral top flap 10 is foldably joined to the upper edge of the main panel 4 along a fold line 12 and an integral bottom flap 14 is foldably joined to the lower edge of the main panel along a fold line 16. The main panel 4 is also provided with a window opening 18 therein. The window 18 may be a simple aperture through the panel or it may be a transparent portion of the sheet from which the blank is formed. Such windows are well known and need not be further described.

The upper flap 10 is provided, along its free edge 20 with a row of relatively small spots 22 of a readily releasable adhesive material. Many such materials are known and need not be described in greater detail except to point out that they may be in the nature of a more or less permanent or moisture activatable adhesive or they may be in the nature of a pressure sensitive adhesive material. As shown in FIG. 2, the upper flap 10 is provided on the face opposite the face appearing in FIG. 1 with a return address indicated at 24. The return address is so positioned on the flap 10 that when the latter is folded downwardly over the upper face of the upper panel, as seen in FIG. 2, that address will be visible through the window 18. As also shown in FIG. 2, the lower flap 14 is preferably of a truncated triangular shape having slanted end edges 26 and an outer or free edge 28. On that face of the blank appearing uppermost in FIG. 2, the flap 14 is provided with a row of adhesive material 30 extending along its free edge 28 and at least part way along the end edges 26. It is to be noted that the adhesive 30 is on the opposite face of the blank from the adhesive materials 22 previously referred to. The adhesive 30 may be and preferably is a permanent type of adhesive, for example, a moisture activatable adhesive of well known type.

Figure 2:
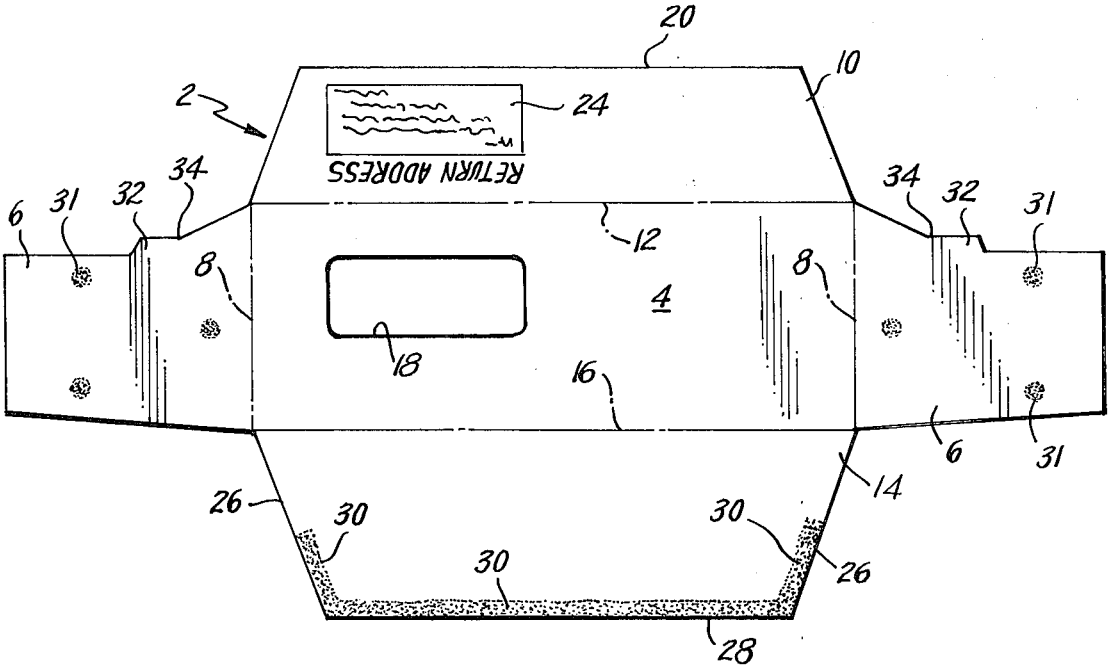
FIG. 2 is a view of the other face of the blank of FIG. 1.

As also shown in the drawings, the face of flap 14 shown uppermost in FIG. 1 is provided with a plurality of spots 31 of a releasable adhesive of the type previously referred to. Also, the other side of end flaps 6, as seen in FIG. 1, which is the upper side of those flaps, as seen in FIG. 2, is shown as also being provided with a plurality of spots of readily releasable adhesive 31. The spots 31 on flap 14 and those on end flaps 6 are positioned so that when the flap 14 overlies a flap 6 the adhesive on one will engage the face of the other. It is to be understood, however, that the adhesive on the end flaps may be omitted and only that on flap 14 employed or on the other hand the adhesive may be omitted from flap 14 and only those spots on end flaps 6 being employed, all for the purpose to be described later.

It will be further seen from the drawings that the upper edges of the end flaps 6, that is, those edges opposite the fold line 16 and adjacent fold line 12 are so configured that when those flaps are folded inwardly over the main panel 4, an elongated portion of the latter adjacent the fold line 12 is exposed above the upper edges of the end flaps. The lower flap 14 is so dimensioned that the distance between fold line 16 and outer edge 28 is no greater than the distance between fold lines 12 and 16 and yet great enough so that the adhesive 30 along the edge 28 will lie between the upper edges of end flaps 6 and the fold line 12. It is further to be noted that the end flaps 6 are provided with a stepped region 32 along their upper edges and when those end flaps are folded inwardly over the main panel 4, the upper edges of the steps 32 coincide with the end portions of edge 28 and the ends of edge 28 coincide with points 34 at the inner ends of the stepped regions 32 on the upper edges of the end flaps.

As stated previously, the blank disclosed and claimed herein is particularly well adapted for handling by automatic machinery. For example, the blank as shown in the drawings may be formed and handled by automatic machinery and further processed by such machinery by folding the end flaps 6 upward and inwardly, as seen in FIG. 1, to overlie panel 4. Then, lower flap 14 can be folded forwardly and upwardly to overlie th e flaps 6 and the releasable adhesive spots 31 caused to hold the flap 14 to the end flaps 6 to form an envelope. It is to be noted that the end portions of the edge 28 of flap 14 will coincide with the upper surfaces of the steps 32, thus defining a more or less continuous upper edge for the envelope which will facilitate automatic or machine stuffing of enclosures into the envelope.

The envelopes thus formed may be supplied to the purchaser in bulk and are in condition to be easily stuffed with a suitable enclosure, all by automatic machinery. Machines for inserting enclosures into envelopes are well known and need not be described. The enclosure placed in the envelope should include an address portion positioned to be visible through the window 18 and thereafter the upper flap 10 is folded downwardly and its releasable adhesive spots 22 then engage and adhere to the outer surface of flap 14 on the back of the envelope. The filled and closed envelope is then ready for its first mailing.

When the customer receives the envelope containing the described enclosure, the same may be easily opened by merely lifting the flap 10 from flap 14 and thus parting or releasing the adhesive 22 and lifting flap 14 by separating the releasable adhesive 31 without tearing or severing any part of the blank whereupon the envelope may be readily unfolded to the position shown in FIG. 1. The customer may then remove the enclosure. Assuming that the enclosure is a monthly bill, the customer may then prepare his remittance and prepare the envelope for remailing. To remail the envelope the blank is turned over from the position of FIG. 1 to the position of FIG. 2 and the top flap 10 is first folded downwardly to overlie the main panel whereby the return address becomes visible through window 18 and becomes the address to which the envelope is to be remailed. The customer then places his check or other enclosure over that flap, then fold the end flaps upwardly and inwardly to overlie his enclosure. As will be obvious, after the end flaps 6 are folded inwardly as described, that portion of the upper surface of flap 10 adjacent the fold line 12 will be exposed whereupon the adhesive 30 on lower flap 14 may be moistened or otherwise treated and the flap folded to overlie the end flaps 6 whereupon the adhesive 30 along edge 28 may be adhered to the exposed portion of flap 10 and the portions of the adhesive along edges 26 engage and adhere to the end flaps 6, thus forming a securely sealed envelope for remailing.

While a single specific form of the invention has been shown, it is to be understood that other forms may be devised falling within the scope of the invention as defined by the appended claims.

I claim:

1. A blank for forming a reversible and returnable envelope, comprising:
- a sheet of material defining a main panel of generally rectangular shape;
- an end flap foldably joined to each end of said main panel;
- a first flap foldably joined to one side edge of said main panel;
- a second flap foldably joined to the other side edge of said main panel;
- the outer edge portion of said first flap having releasable adhesive means thereon on one face of said blank;
- the outer edge portion of said second flap having moisture activatable adhesive extending therealong on the other face of said blank;
- further releasable adhesive means on said blank for releasably holding said second flap to said end flaps when said second flap overlies said end flaps over said one face of said blank;
- said main panel having a window therethrough; and
- said first flap having a return address printed thereon, on said other face of said blank in position to appear through said window when said first flap is folded to overlie said main panel on said other face of said blank.

2. A blank as defined in claim 1 wherein the upper edges of said end flaps are so configured that, when folded over said main panel, they leave exposed a portion of said main panel adjacent said one side edge of said main panel and the width of said second flap being such that, when folded over said end flaps, said moisture activatable adhesive lies between said upper edges of said end flaps and the adjacent edge of said main panel.

3. A blank as defined in claim 2 wherein said moisture activatable adhesive extends also along at least portions of end edges of said second flap.

4. A blank as described in claim 1 wherein said releasable adhesive means is a pressure sensitive adhesive.

5. A blank as defined in claim 1 wherein said releasable adhesive means comprises a plurality of spots of adhesive material.

6. A blank as defined in claim 1 wherein said further releasable adhesive means comprises at least one spot of adhesive material on said second flap on said one face of said blank.

7. A blank as defined in claim 1 wherein said further releasable adhesive means comprises at least one spot of adhesive material on said end flaps on said other face of said blank.

8. A blank as defined in claim 1 wherein said end flaps are configured to have upper edge portions coincident with the outer edge portions of said second flap when said second and end flaps overlie said main panel.

* * * * *